US008950727B2

(12) United States Patent
Skudelny

(10) Patent No.: US 8,950,727 B2
(45) Date of Patent: Feb. 10, 2015

(54) SNORKEL HOLDER APPARATUS

(76) Inventor: Kai Skudelny, Appiano sulia Strada del vino (IT)

( * ) Notice: Subject to any disclaimer, the term of this patent is extended or adjusted under 35 U.S.C. 154(b) by 0 days.

(21) Appl. No.: 13/640,580

(22) PCT Filed: Apr. 13, 2011

(86) PCT No.: PCT/EP2011/055778
§ 371 (c)(1),
(2), (4) Date: Nov. 5, 2012

(87) PCT Pub. No.: WO2011/128361
PCT Pub. Date: Oct. 20, 2011

(65) Prior Publication Data

US 2013/0037662 A1 Feb. 14, 2013

(30) Foreign Application Priority Data

Apr. 15, 2010 (IT) ..... BZ2010A0014

(51) Int. Cl.
*A47G 29/00* (2006.01)
*B63C 11/20* (2006.01)
*B63C 11/12* (2006.01)

(52) U.S. Cl.
CPC ..... *B63C 11/205* (2013.01); *B63C 2011/128* (2013.01)
USPC ..... 248/683; 248/537; 128/201.27; 224/183

(58) Field of Classification Search
CPC B63C 11/205; B63C 2011/128; B63C 11/12; B63C 11/16; F16M 11/041; H01F 7/0252
USPC ..... 248/683, 537, 206.5, 309.4; 128/201.11, 201.27, 201.26; 224/183, 224/547, 562
See application file for complete search history.

(56) References Cited

U.S. PATENT DOCUMENTS

| | | | | |
|---|---|---|---|---|
| 4,907,582 | A * | 3/1990 | Meyerrose | 128/201.11 |
| 5,265,591 | A * | 11/1993 | Ferguson | 128/201.11 |
| 6,042,080 | A * | 3/2000 | Shepherd et al. | 248/683 |
| 6,352,075 | B1 * | 3/2002 | Wang | 128/201.11 |
| 6,382,482 | B1 * | 5/2002 | Chao | 224/312 |
| 6,561,206 | B1 * | 5/2003 | Wilkinson | 135/65 |
| 6,736,136 | B2 * | 5/2004 | Chen-Lieh | 128/201.11 |
| 7,374,142 | B2 * | 5/2008 | Carnevali | 248/206.5 |
| 7,699,277 | B2 * | 4/2010 | Bagnall | 248/206.5 |
| 7,862,197 | B2 * | 1/2011 | Gebhard | 362/191 |
| 2004/0079365 | A1 * | 4/2004 | Sato | 128/201.11 |
| 2006/0272635 | A1 * | 12/2006 | Shiue | 128/201.11 |
| 2007/0272237 | A1 | 11/2007 | Shiue | |
| 2007/0272238 | A1 * | 11/2007 | Shiue | 128/201.11 |
| 2010/0019110 | A1 * | 1/2010 | Shepley | 248/206.5 |
| 2010/0237206 | A1 * | 9/2010 | Barker | 248/206.5 |
| 2010/0252033 | A1 * | 10/2010 | Navarro Moya | 128/201.11 |

FOREIGN PATENT DOCUMENTS

WO 2009/065989 5/2009

* cited by examiner

*Primary Examiner* — Bradley Duckworth
(74) *Attorney, Agent, or Firm* — Jacobson Holman, PLLC

(57) ABSTRACT

A supporting device for a snorkel is described, comprising a fixing element for a diving mask strap.
According to the invention, the fixing element is formed by a clip (1) suitable for being fixed to a tubular portion of a snorkel and by a clip (2) suitable for being fixed to a diving mask strap, the clips (1, 2) being provided with connectors (5, 11) suitable for coming into contact with each other, each connector (5, 11) featuring a magnetic property for mutual attraction of the two clips.

8 Claims, 3 Drawing Sheets

SNORKEL HOLDER APPARATUS

This is a national stage of PCT/EP11/055,778 filed Apr. 13, 2011 and published in German, which has a priority of Italian no. BZ2010A000014 filed Apr. 15, 2010, hereby incorporated by reference.

The present invention refers to a supporting device for a snorkel according to the pre-characterizing portion of claim 1.

The use of snorkels is common for underwater swimming. The snorkel may be self-standing or connected to the swimmer's neck or to the diving mask. In the latter case, the snorkels are releasably connected with a strap to the mask. This way of fixing does not always provide for an easy mounting and unmounting of the snorkel, especially if one wants to remove the snorkel in order to wear it without the mask.

The aim of the present invention is that of realizing a method of mounting and unmounting which is quick and easy either during snorkel operation and when the snorkel is not in use, ensuring that during operation both modes of carrying the snorkel connected to the mask or independently from the mask are allowed.

This aim is achieved by a snorkel supporting device according to the characterizing portion of claim 1.

By proposing a clip for a mask strap and a separate clip embracing the snorkel on its straight portion, both clips can be attracted toward each other by respective magnetic plates, or by a magnetic plate and a ferromagnetic one, which are housed in a connector of the respective clip in such a way that the plates may oppose each other.

In a preferred embodiment the clip connector for the snorkel is opposed to the opening of the clip. On the other hand, the clip connector suitable for being mounted on the mask strap is next to the clip opening, i.e. an arm of the clip is formed by the connector.

In an alternative embodiment the connectors respectively feature a housing suitable for housing a magnetic plate, or respectively a ferromagnetic plate, in such a way as to be closed at the insertion side by means of a closing element.

Figure 1:
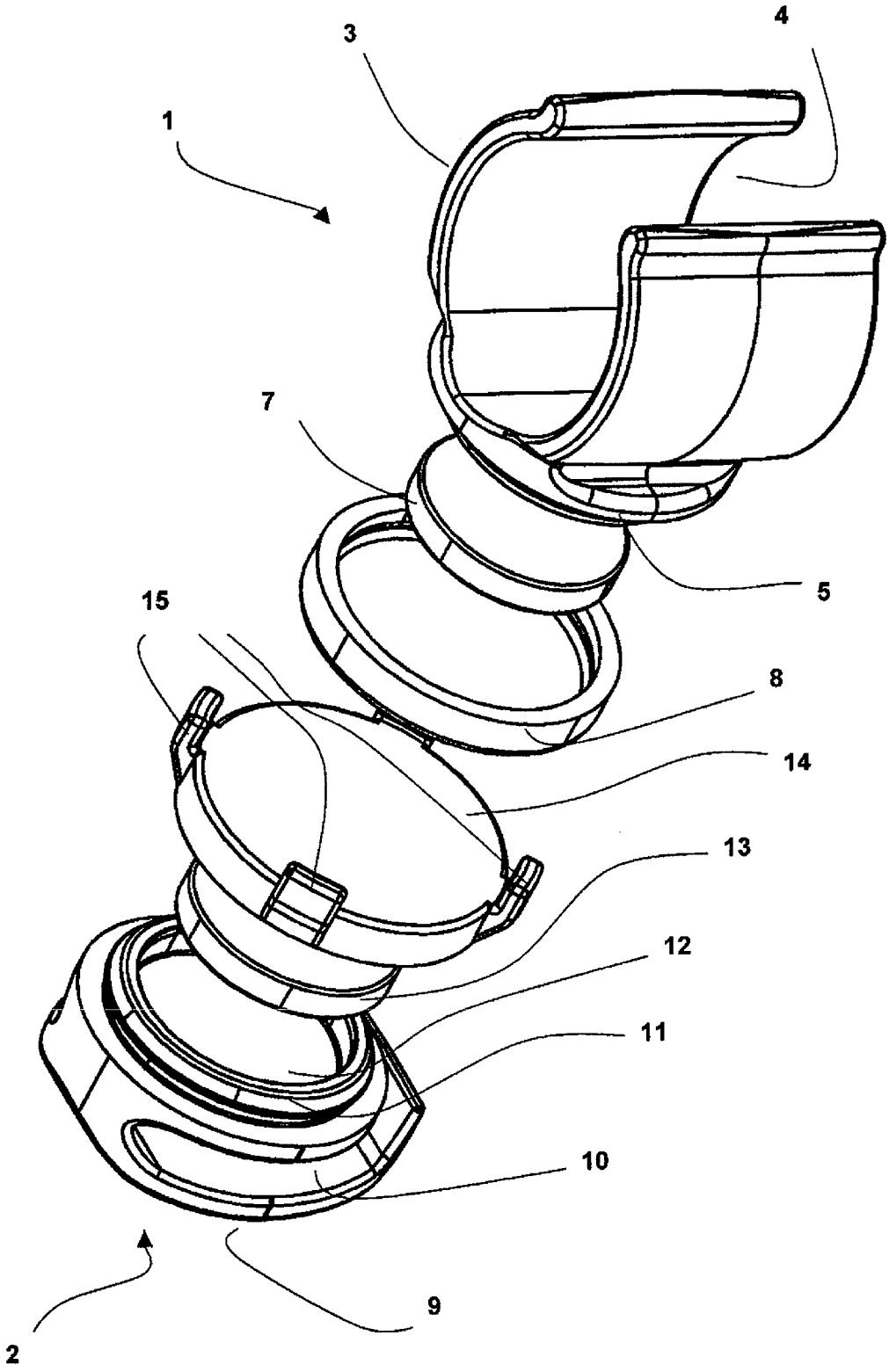
Figure 2:
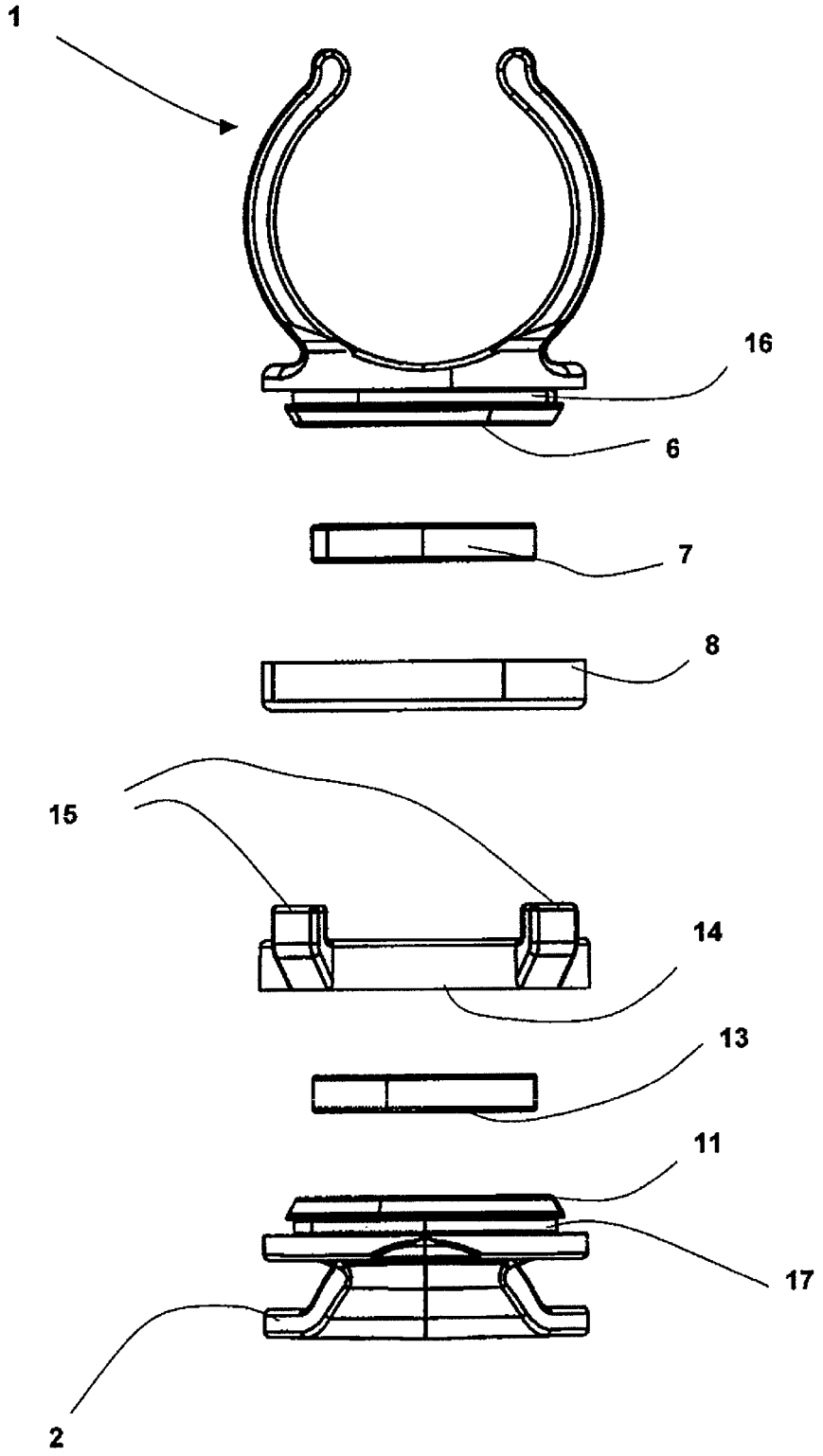
Figure 3:
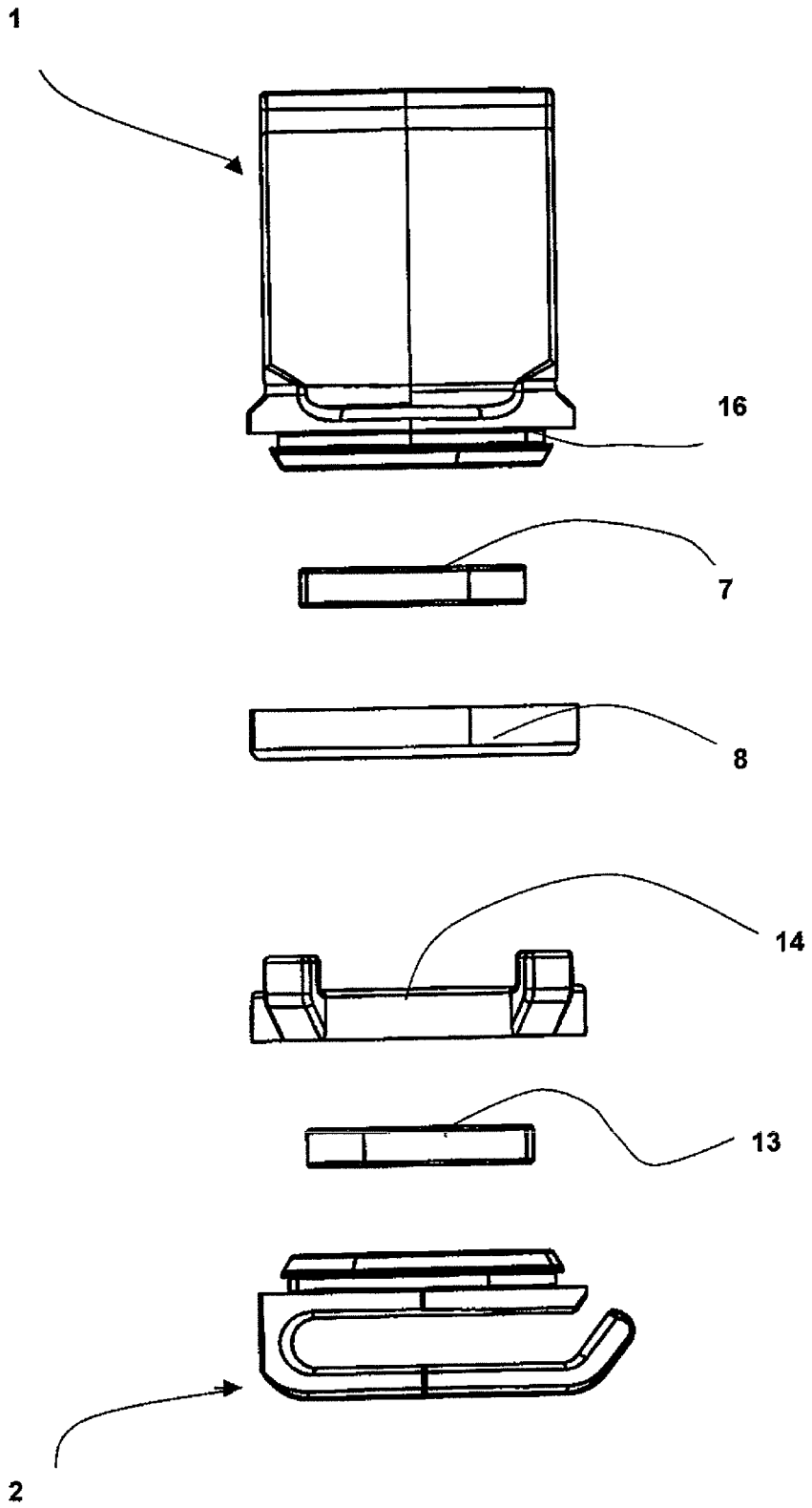

Further features and advantages will emerge from the claims and from the following description of a preferred embodiment, shown in the annexed drawings, wherein:

FIG. 1→shows an exploded perspective view of a supporting device according to the invention, FIG. 2→shows a perspective view of the supporting device according to the invention mounted on a mask strap and on a snorkel, FIG. 3→shows a longitudinal section rotated by 90° with respect to FIG. 2.

A snorkel supporting device according to the invention is shown in the figures, being formed of a clip 1 suitable for being mounted on a tubular portion (not shown) of a snorkel and by a clip 2 suitable for being mounted on a diving mask strap.

The snorkel clip 1 features a partially circular band 3 with an opening 4 for snap-fitting of the tubular portion of a snorkel. Opposite to the opening 4, a connector 5 features a housing suitable for housing a magnetic plate 7 with substantial form fit. Advantageously the housing 7 may be closed by an element 8 to be welded on the portion 5.

On the other hand, the mask clip 2 is formed by a hook 9 featuring an opening 10 for housing a strap. Next to the opening 10 a connector 11 is placed, which features a housing 12 suitable for housing a magnetic plate 13 with a substantial form fit. The opening of the housing 12 may be advantageously closed by means of a closing element 14 to be welded on the flat portion.

Due to the magnetic attraction between the plates, the clips may be joined in a releasable manner either for holding the snorkel to the mask (either during operation or when not in use) and for detaching the snorkel from the mask (either during operation or when not in use).

In order to prevent a relative displacement of the closing elements 8 and 14, one 14 of them is provided with gripping teeth 15 on its perimeter so as to hold the other closing element 8.

As an alternative to welding, the connector 11 may be provided with an undercut 16 for snap-fitting of the closing element 8 and the connector 11 may be provided with an undercut 17 for snap-fitting of the closing element 14.

LIST OF REFERENCE NUMBERS

1 clip
2 clip
3 circular band
4 opening
5 connector
6 housing
7 magnetic plate
8 closing element
9 hook
10 opening
11 connector
12 housing
13 magnetic plate
14 closing element
15 gripping tooth
16 undercut
17 undercut

The invention claimed is:

1. A supporting device for a snorkel, comprising a fixing element for a diving mask strap, characterized in that the fixing element is formed by a first clip suitable for being fixed to a tubular portion of a snorkel and by a second clip suitable for being fixed to a diving mask strap, the first and second clips being provided with connectors suitable for coming into contact with each other, each connector featuring a magnetic property for mutual attraction of the first and second clips, and each of the connectors comprises a housing in which magnetic plates or magnetic and ferromagnetic plates are respectively enclosed therein, the housings being closed by closing elements, and the closing elements are releasably connected with each other.

2. The supporting device according to claim 1, characterized in that the first clip features a partially circular band with an opening for snap-fitting of the tubular portion of a snorkel, the connector being opposed to the opening and comprising the housing that encloses a magnetic plate with a substantial form fit.

3. The supporting device according to claim 2, characterized in that the housing is closed by the closing elements connectable with the connectors.

4. The supporting device according to claim 1, characterized in that the second clip is formed by a hook comprising an opening for housing a diving mask strap, a connector, a housing that encloses a magnetic plate with a substantial form fit, being placed next to the opening.

5. The supporting device according to claim 1, characterized in that in order to prevent a relative displacement of the closing elements, one of the closing elements is provided with gripping teeth on its perimeter so as to releasably hold the other closing element.

6. The supporting device according to claim 1, characterized in that each of the connectors is provided with an undercut for snap-fitting of the closing element.

7. The supporting device according to claim 1, wherein the closing elements are respectively welded to the connectors.

8. A supporting device for a snorkel, comprising a fixing element for a diving mask strap, characterized in that the fixing element is formed by a first clip suitable for being fixed to a tubular portion of a snorkel and by a second clip suitable for being fixed to a diving mask strap, the first and second clips being respectively provided with a first connector and a second connector suitable for coming into contact with each other, each connector featuring a magnetic property for mutual attraction of the first and second clips, and the first and second connectors respectively comprises a first housing and a second housing in which magnetic plates or magnetic and ferromagnetic plates are respectively housed, the first and second housings being respectively closed by a first and a second closing elements, and the first and second closing elements are releasably connected with each other;

wherein the first clip features a partially circular band with an opening for snap-fitting of the tubular portion of a snorkel, the first connector being opposed to the opening and comprising the first housing that encloses a magnetic plate or a ferromagnetic plate with a substantial form fit;

wherein the second clip is formed by a hook featuring an opening for housing a diving mask strap, the second connector, the second housing that encloses a magnetic plate or a ferromagnetic plate with a substantial form fit, being placed next to the opening;

wherein in order to prevent a relative displacement of the closing elements, one of the closing elements is provided with gripping teeth on its perimeter so as to hold the other closing element;

wherein each of the connectors is provided with an undercut for snap-fitting of the respective closing element.

* * * * *